US005975774A

United States Patent [19]

Blakely et al.

[11] Patent Number: 5,975,774

[45] Date of Patent: Nov. 2, 1999

[54] COMPACT PROCESSING APPARATUS AND METHOD FOR PROCESSING PHOTOSENSITIVE MATERIAL

[75] Inventors: Kevin H. Blakely, Rochester; Ralph L. Piccinino, Jr., Rush, both of N.Y.

[73] Assignee: Eastman Kodak Company, Rochester, N.Y.

[21] Appl. No.: 09/066,059

[22] Filed: Apr. 24, 1998

[51] Int. Cl.[6] ..... G03D 3/02; G03D 3/08; G03D 13/04

[52] U.S. Cl. ..... 396/617; 396/620; 396/636; 396/626

[58] Field of Search ..... 396/617, 620, 396/641, 636, 626

[56] References Cited

U.S. PATENT DOCUMENTS

| | | | |
|---|---|---|---|
| 4,178,089 | 12/1979 | Spence-Bate | 396/636 |
| 4,469,425 | 9/1984 | Cocco et al. | 396/617 |
| 5,179,404 | 1/1993 | Bartell et al. | 396/617 |
| 5,270,762 | 12/1993 | Rosenburgh et al. | 396/626 |
| 5,311,235 | 5/1994 | Piccinino, Jr. et al. | 396/641 |
| 5,347,337 | 9/1994 | Patton et al. | 396/626 |
| 5,386,261 | 1/1995 | Patton et al. | 396/620 |
| 5,420,658 | 5/1995 | Manico et al. | 395/619 |
| 5,432,581 | 7/1995 | Patton et al. | 396/620 |
| 5,761,563 | 6/1998 | Earle | 396/636 |

OTHER PUBLICATIONS

Foster et al., entitled Improved Photographic Processor and Method or Operation, USSN 08/724,096 filed Sep. 30, 1996; Pat. No. 5,778,274.

Foster et al., entitled Improved Photographic Processor and Method of Operation, USSN 08/720,400 filed Sep. 30, 1996; Pat. No. 5,749,017.

Foster et al., entitled Improved Photographic Processor and Method of Operation, USSN 08/720,403 filed Sep. 30, 1996; Pat. No. 5,761,561.

Foster et al., entitled Improved Photographic Processor and Method of Operation, USSN 08/720,401 filed Sep. 30, 1996; Pat. No. 5,771417.

Gates et al., entitled Improved Photographic Processor and Method of Operation, USSN 08/724,717 filed Sep. 30, 1996; Pat. No. 5,822,644.

Foster et al., entitled Improved Photographic Processor and Method of Operation, USSN 08/723,336 filed Sep. 30, 1996; Pat. no. 5,790914.

Rosenburgh et al., entitled Improved Photographic Processor and Method of Operation, USSN 08/723,798 filed Sep. 30, 1996; Pat. No. 5,781,820.

Rosenburgh et al., entitled Improved Photographic Processor and Method of Operation, USSN 08/723,337 filed Sep. 30, 1996; Pat. No. 5,778,272.

*Primary Examiner*—Safet Metjahic
*Attorney, Agent, or Firm*—David A. Novais

[57] ABSTRACT

A processing apparatus and method combines thin channel and nozzle technology, as well as cascading processing solution flow. The processing apparatus includes a base member that defines at least one opening which has a longitudinal axis that extends at an angle with respect to a horizontal axis, and at least one rack member which is removably insertable in the at least one opening. When inserted in the at least one opening, a processing path is defined between an inner surface of the opening and an outer surface of the rack member. The openings are configured so as to provided for a compact arrangement and the rack members are removable in a manner which facilitates maintenance and repair.

27 Claims, 5 Drawing Sheets

11a, 11b; 14a, 14b; 17a, 17b;
19a, 19b; 21a, 21b; 23a, 23b 11a, 11b; 14a, 14b; 17a, 17b;
19a, 19b; 21a, 21b; 23a, 23b

COMPACT PROCESSING APPARATUS AND METHOD FOR PROCESSING PHOTOSENSITIVE MATERIAL

FIELD OF THE INVENTION

The present invention relates to the field of photoprocessing, and more particularly, to a compact processing apparatus and method for processing photosensitive material.

BACKGROUND OF THE INVENTION

The processing of photosensitive material such as photographic film or paper involves a series of steps such as developing, bleaching, fixing, washing and drying. In the processing of photosensitive material, a continuous web of film or cut sheet of film or photographic paper is sequentially conveyed through a series of stations or tanks, with each one containing a different processing solution appropriate to the process step at that station. In conventional arrangements, the tanks of the processor are usually set forth in a side by side relationship. This arrangement increases the foot print of the processor and thus requires a large amount of floor space.

U.S. Pat. No. 5,369,261 discloses a low volume photographic processing apparatus that utilizes a plurality of processing modules. In this document, a narrow horizontal processing channel is disclosed and nozzles are arranged along the processing channel for introducing recirculated fluid into the processing path. However, with the specific module structure of U.S. Pat. No. 5,369,261, there is no provision for a cascading flow of fresh processing solution into the processing channel.

SUMMARY OF THE INVENTION

The present invention provides for a processing apparatus and method which includes the benefits of a thin-channel rack-and-tank arrangement as shown in, for example, U.S. Pat. No. 5,311,236 the subject matter which is herein incorporated by reference, and uses less floor space.

The processing apparatus of the present invention includes removable rack members which are insertable into associated openings of a base member to define different processing sections of the processing apparatus. The openings extend at an angle with respect to a horizontal axis, and the removable rack members are insertable into the angled openings. The removable feature of the rack members facilitates maintenance, cleaning and repair of the apparatus. Further, the openings and rack members are positioned one above the other so as to provide for a compact arrangement. The insertion of the rack members in the openings provide for processing paths which each have downwardly and upwardly inclined portions with respect to a direction of travel of photosensitive material. With the arrangement of the present invention, it is possible to provide a cascading flow of fresh processing solution along the upwardly inclined portion of each of the processing paths, and at the same time, recirculate processing solution from the cascading processing solution flow to the downwardly inclined portions of each of the processing paths.

Additionally, the combination of the placement of the openings one above the other and the processing paths being thin channels provides for a compact arrangement which requires less processing solution. Furthermore, each of the thin channels can include textured surfaces so as to promote agitation of the solution.

Also, the processing paths defined by each of the rack members and openings make up a continuous processing path which can convey photosensitive material in a light-tight manner so as to minimize exposure to air.

The present invention relates to a processing apparatus for photosensitive material which comprises a base member having at least one opening, with the at least one opening having a longitudinal axis which extends at a predetermined angle with respect to a horizontal axis; and at least one rack member which is removably insertable into the at least one opening, so as to define a processing path for photosensitive material therebetween when the at least one rack member is inserted in the at least one opening.

The present invention further relates to a processing apparatus for photosensitive material which comprises a base member having a plurality of openings, each of the openings having a longitudinal axis which extends at a predetermined angle with respect to a horizontal axis, the longitudinal axes of each of the openings being approximately parallel to each other, and the openings being positioned one above the other; a first rack member removably insertable in a first one of the plurality of openings so as to define a first processing path for photosensitive material therebetween when the first rack member is inserted in the first one of the plurality of openings; a second rack member removably insertable in a second one of the plurality of openings so as to define a second processing path therebetween which continues from the first processing path when the second rack member is inserted in the second one of the plurality of openings; and a third rack member removably insertable in a third one the plurality of openings, so as to define a third processing path therebetween which continues from the second processing path when the third rack member is inserted in the third one of the plurality of openings.

The present invention further relates to a method of processing photosensitive material. The method comprises the step of forming at least one processing path for a passage of photosensitive material therethrough, between an inner surface of at least one opening of a base member and outer surface of at least one rack member removably insertable in the at least one opening, when the at least one rack member is inserted in the at least one opening. The at least one opening has a longitudinal axis which extends at a predetermined angle with respect to a horizontal axis.

DETAILED DESCRIPTION OF THE INVENTION

Figure 1:
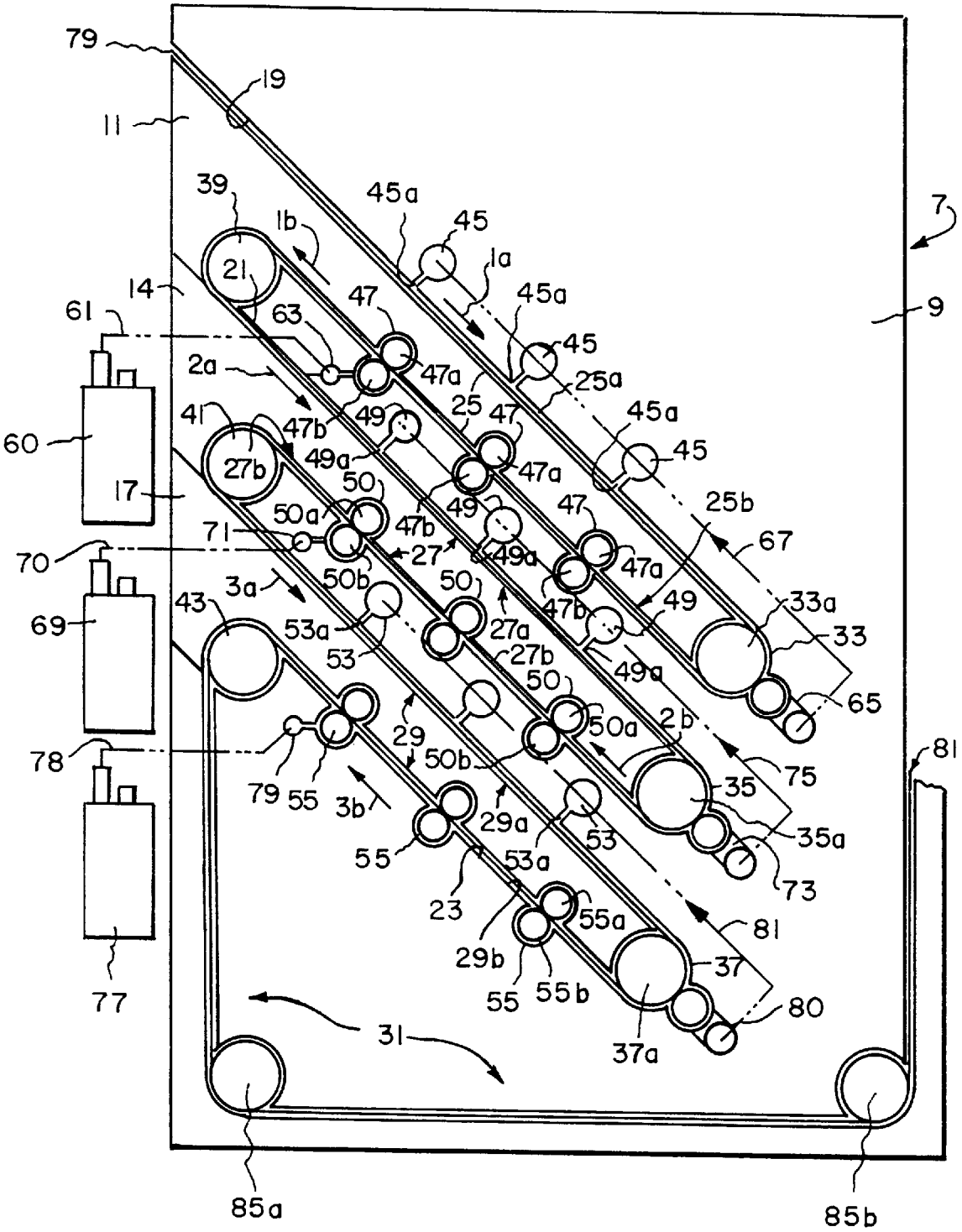
FIG. 1 is a schematic illustration of the processing apparatus of the present invention.
Figure 2:
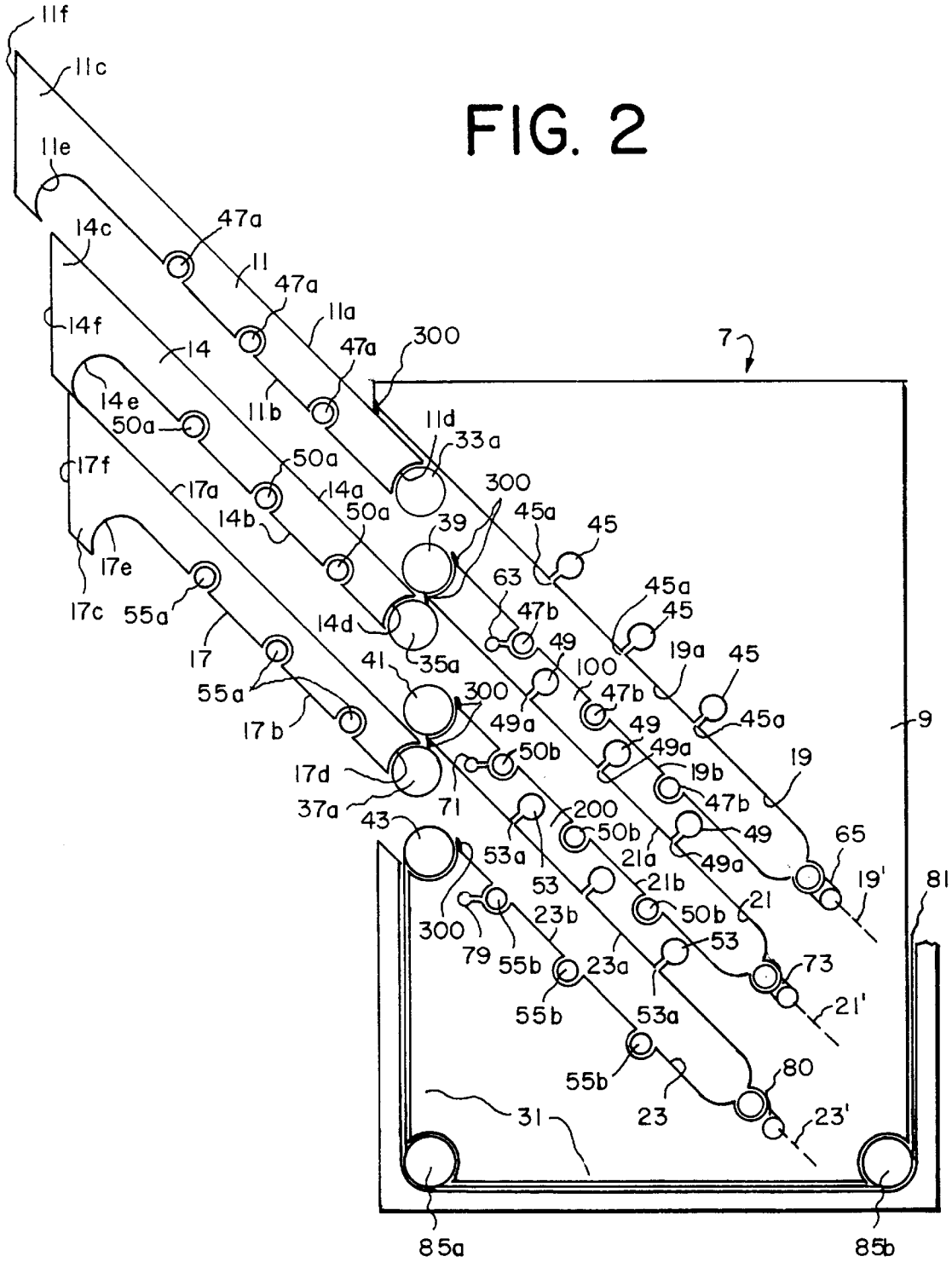
FIG. 2 is a view of the processing apparatus of FIG. 1 with the rack members being removed from the openings of the base member.

Referring now to the drawings, wherein like references numerals designate identical or corresponding parts throughout the several views, FIGS. 1 and 2 illustrate a first example of a processing apparatus 7 in accordance with the present invention. As shown in FIGS. 1 and 2, processing apparatus 7 includes a base member 9 having first, second and third openings 19, 21 and 23. As illustrated in FIG. 1, first, second and third rack members 11, 14 and 17 are removably insertable within corresponding openings 19, 21 and 23. Openings 19, 21 and 23 can be more clearly seen in FIG. 2, which illustrates processing assembly 9 with rack members 11, 14 and 17 removed from their corresponding openings 19, 21 and 23.

As illustrated in the FIG. 2, each of openings 19, 21, 23 is inclined and has a respective longitudinal axis 19', 21', 23' which extends at an approximately 45° angle from a horizontal axis. Additionally, each of openings 19, 21 and 23 is positioned one above the other as shown in FIG. 2. This combination of features provides for a compact unit which uses less floor space.

Referring to both FIGS. 1 and 2, the insertion of first rack member 11 within first opening 19 provides for a first processing path 25 for the passage of photosensitive material therethrough; the insertion of second rack member 14 within second opening 21 provides for a second processing path 27 for the passage of photosensitive material therethrough; and the insertion of third rack member 17 within third opening 23 provides for a third processing path 29 for the passage of photosensitive material therethrough. Each of processing paths 25, 27 and 29 are communicated with each other in a light-tight manner and define a different processing stage for the processing of photosensitive material. For example, processing path 25 could be a developing processing path during which developing solution is applied to photosensitive material passing therethrough; processing path 27 could be a bleaching processing path during which bleaching solution is applied to photosensitive material passing therethrough; and processing path 29 could be a washing processing path during which washing solution is applied to the photosensitive material passing therethrough. After the photosensitive material leaves third processing path 29, it is conveyed through a path 31 to, for example, a drying stage.

As illustrated in FIG. 1, first processing path 25 includes a downwardly inclined portion 25*a* with respect to a conveying direction as illustrated by arrow 1*a* of photosensitive material in downwardly inclined portion 25*a*, and an upwardly inclined portion 25*b* with respect to a conveying direction as illustrated by arrow 1*b* of photosensitive material in upwardly inclined portion 25*b*. First processing path 25 further includes a turnaround portion 33 which comprises a conveying roller 33*a* positioned between downwardly inclined portion 25*a* and upwardly inclined portion 25*b*. Turnaround portion 33 and conveying roller 33*a* guide the photosensitive material from downwardly inclined portion 25*a* to upwardly inclined portion 25*b*.

Second processing path 27 includes a downwardly inclined portion 27*a* with respect to a conveying direction of photosensitive material in downwardly inclined portion 27*a* as illustrated by arrow 2*a*, and a upwardly inclined portion 27*b* with respect to a conveying direction of photosensitive material in upwardly inclined portion 27*b* as illustrated by arrow 2*b*. Second processing path 27 further includes a turnaround portion 35 which comprises a conveying roller 35*a* positioned between downwardly inclined portion 27*a* and upwardly including portion 27*b*. Turnaround portion 35 and conveying roller 35*a* help to guide the photosensitive material from downwardly inclined portion 27*a* to upwardly inclined portion 27*b*.

Third processing path 29 includes a downwardly inclined portion 29*a* with respect to a conveying direction of the photosensitive material in downwardly inclined portion 29*a* as illustrated by arrow 3*a*, and a upwardly inclined portion 29*b* with respect to a conveying direction of the photosensitive material in upwardly inclined portion 29*b* as illustrated by the arrow 3*b*. A turnaround portion 37 comprises a conveying roller 37*a* positioned between downwardly inclined portion 29*a* and upwardly inclined portion 29*b*. Turnaround portion 37 and conveying roller 37*a* help guide the photosensitive material from downwardly inclined portion 29*a* to upwardly inclined portion 29*b*.

Processing apparatus 7 further includes transfer rollers 39, 41 and 43 which guide the photosensitive material from one processing path to the next. Conveying roller 39 guides photosensitive material from an exit of first processing path 25 to an entrance of second processing path 27, conveying roller 41 guides photosensitive material from an exit of second processing path 27 to an entrance of third processing path 29, and conveying roller 43 guides photosensitive material from an exit of third processing path 29 to path 31 which leads to, for example, a drying stage.

As further illustrated in FIG. 1, processing apparatus 7 includes a processing solution supply assembly which comprises a recirculation and replenishment arrangement, overflow tray sections and nozzles. As shown in FIG. 1, downwardly inclined portion 25*a* of first processing path 25 includes nozzles 45 having nozzle openings 45*a* which open into downwardly inclined portion 25*a*. Upwardly inclined portion 25*b* of first processing path 25 includes overflow tray sections 47 which can be curved so as to accommodate rollers 47*a*, 47*b*.

Downwardly inclined portion of 27*a* of second processing path 27 includes nozzles 49 which lead to nozzles opening 49*a* that open into downwardly inclined portion 27*a*. Upwardly inclined portion 27*b* of second processing path 27 includes overflow tray sections 50 which are similar in structure to overflow tray sections 47 and include rollers 50*a*, 50*b*.

Downwardly inclined portion 29*a* of third processing path 29 include nozzles 53 that comprise openings 53*a* which lead into downwardly inclined portion 29*a*. Upwardly inclined portion 29*b* of third processing path 29 includes overflow tray sections 55 which are similar in structure to overflow tray sections 47 and 50, and include rollers 55*a*, 55*b*.

The recirculation and replenishment arrangement of processing apparatus 7 will now be described. As previously explained, upwardly inclined portions 25*b*, 27*b* and 29*b* of each of processing paths 25, 27, 29 respectively include overflow tray sections 47, 50, 55. This arrangement provides for a cascading overflow application of processing solution in a manner as described in co-pending application U.S. Ser. No. 08/947,688 filed Oct. 9, 1997, the subject matter of which is herein incorporated by reference. That is, with reference to first processing path 25, a first fresh processing solution can be supplied via a pump and container arrangement 60 (which can be, for example, a bellows pump) via a line 61 to entrance 63 of an uppermost overflow tray section of overflow tray sections 47. The first processing solution will overflow uppermost overflow tray section 47 and cascade down along upwardly inclined portion 25*b* in a direction opposite to conveying direction 1*b* of the photosensitive material in upwardly inclined portion 25*b*. The first processing solution will sequentially overflow tray sections 47 as it flows downward along upwardly inclined portion 25*b* so as to provide for a cascading downward flow of the first processing solution. The rollers 47*a*, 47*b* of each overflow tray section 47 will help convey the photosensitive material along upwardly inclined portion 25*b* while at the same time helping to apply the first processing solution to the photosensitive material. The downwardly cascading flow of the first processing solution along upwardly inclined portion 25*b* will collect in a recirculation pump and trough assembly 65 located in a vicinity of turnaround portion 33. Recirculation assembly 65 circulates the first processing solution from the downwardly cascading flow to line 67 and thereafter to each of nozzles 45. This provides for a supply of recirculated first processing solution to downwardly inclined portion 25*a* via openings 45*a*.

The same process for recirculation and replenishment will be applicable to second processing path 27 and third processing path 29. That is, in second processing path 27, a pump and container arrangement 69 similar to arrangement 60 will supply a second fresh processing solution via line 70 into an entrance 71 of an uppermost overflow tray section of overflow tray sections 50. The second processing solution will overflow uppermost tray section 50 and cascade in a downward direction along upwardly inclined portion 27*b*. The second processing solution is collected in a recirculation pump and trough assembly 73 located in a vicinity of turnaround portion 35. Recirculation assembly 73 recirculates the second processing solution along line 75 to each of nozzles 49 along downwardly inclined portion 27*a*, so as to supply recirculated second processing solution along downwardly inclined portion 27*a*.

Third processing path 29 includes a further pump and container arrangement 77 which supplies a third fresh processing solution via line 78 into an entrance 79 of an uppermost overflow tray section of overflow tray sections 55. The third processing solution will overflow uppermost tray section 55 and cascade downwardly along upwardly inclined portion 29*b*. The third processing solution collects at a recirculation pump and trough assembly 80 located in a vicinity of turnaround portion 37. Recirculation assembly 80 will recirculate the third processing solution along line 81 to each of nozzles 53 located along downwardly inclined portion 29*a*, so as to provide recirculated third processing solution along downwardly inclined portion 29*a*.

With the configuration of the present invention, pump and container arrangement 60 could supply fresh developing solution, pump and container arrangement 69 could supply fresh bleaching solution, and pump and container arrangement 77 could supply fresh washing solution.

An operating example of processing apparatus 7 as illustrated in FIG. 1 will now be explained. During use of processing apparatus 7, photosensitive material having its emulsion side oriented upwardly enters at entrance 79 and travels along downwardly inclined portion 25*a* of first processing path 25, where is impinged and processed by recirculated processing solution delivered via openings 45*a* by nozzles 45. As previously described, this recirculating solution is supplied to nozzles 45 via recirculation assembly 65. The photosensitive material thereafter travels around turnaround portion 33 and is conveyed, emulsion side downwardly oriented, into upwardly inclined portion 25*b* of first processing path 25. Along upwardly inclined portion 25*b*, the photosensitive material is processed by fresh processing solution supplied by pump and container arrangement 60 and applied by overflow tray sections 47, which create a cascading downward flow. At this point, the photosensitive material will have passed through, for example, a developing section.

The photosensitive material is thereafter conveyed around roller 39 toward second processing path 27 and downwardly inclined portion 27*a*. As the photosensitive material having its emulsion side upwardly oriented is conveyed along downwardly inclined portion 27*a*, it is impinged and processed by recirculated processing solution applied by nozzles 49 via openings 49*a*. The processing solution, for example, could be a bleaching solution. As previously described, the recirculated processing solution is supplied to nozzles 49 via recirculation assembly 73. The photosensitive material is thereafter conveyed around turnaround portion 35 to upwardly inclined portion 27*b* of processing path 27. Along upwardly inclined portion 27*b*, the emulsion side of the recirculating solution is oriented downwardly. As the photosensitive material travels along upwardly inclined portion 27*b*, fresh processing solution, for example, bleaching solution is applied in a cascading manner by way of overflow tray sections 50.

The photosensitive material thereafter exits second processing path 27 and is conveyed by roller 41 to third processing path 29. As photosensitive material travels along downwardly inclined portion 29*a* of third processing path 29, the photosensitive material will have its emulsion side oriented upwardly. The photosensitive material in downwardly inclined portion 29*a* is impinged and processed with recirculated processing solution, such as washing solution, by way of openings 53*a* of nozzles 53. As previously explained, this recirculated solution is supplied to nozzles 53 by way of recirculation assembly 80. The photosensitive material is thereafter conveyed around turnaround portion 37 to upwardly inclined portion 29*b* of processing path 29 where the photosensitive material has its emulsion side oriented downwardly. As the photosensitive material travels along upwardly inclined portion 29*b*, fresh solution is applied via overflow tray sections 55 by way of a cascading downward flow. The photosensitive material is thereafter conveyed by roller 43 to path 31 which leads to an exit 81. Path 31 can include further rollers 85*a*, 85*b* which help convey the photosensitive material through path 31. After the photosensitive material exits at exit 81, it can be lead to, for example, a drying stage.

FIGS. 1 and 2 illustrate nozzles 45, 49, 53 within base member 9. The present invention is not limited to this structure and it is recognized that as an alternative structure, nozzles 45, 49, 53 could instead be respectively provided on each of rack members 11, 14 and 17.

The structure of base member 9 and rack members 11, 14, 17 of processing apparatus 7 will now be described with reference to FIG. 2. As illustrated in FIG. 2, processing apparatus 7 includes first, second and third openings 19, 21 and 23. In order to provide for a compact arrangement, openings 19, 21 and 23 each have a respective longitudinal axis 19', 21', 23' which makes an approximately 45° angle with a horizontal axis. Additionally, each of openings 19, 21 and 23 are vertically positioned one above the other and extend substantially parallel to one another. This specific arrangement provides for a compact structure which permits photosensitive material to be conveyed through the apparatus in a light-tight manner.

As further shown in FIG. 2, an inner surface of first opening 19 includes a first section 19*a* which includes openings 45*a* for nozzles 45 and a second section 19*b* which includes parts (i.e. rollers 47*b*) of overflow tray sections 47. First rack member 11 is structured so as to be slideably fitted within first opening 19 as illustrated in FIG. 1. First rack member 11 includes a first surface 11*a* and a second surface 11*b*, and can include a handle portion 11*c* so as to facilitate insertion and removal of first rack member 11 into and from first opening 19. As illustrated in FIG. 2, surface 11*b* of first rack member 11 includes the remaining parts (i.e. rollers 47*a*) of overflow tray sections 47, as well as a curved surface 11*d* which matches the curvature of turnaround roller 33*a*. As further illustrated in FIG. 2, handle portion 11*c* can include a curved section 11*e* which matches the curvature of roller 39. Therefore, when first rack member 11 is inserted within opening 19, downwardly inclined portion 25*a* of first processing path 25 is defined between first surface 11*a* of first rack member 11 and first section 19*a* of opening 19, while upwardly inclined 25*b* of first processing path 25 is defined between second surface 11*b* of first rack member 11 and second section 19*b* of opening 19, so as to form first processing path 25 as illustrated in FIG. 1. Additionally, curved section 11*e* partially surrounds roller 39 so as to guide photosensitive material from processing path 25 to processing path 27. Also, the parts (i.e. rollers 47*a*, 47*b*) of overflow tray sections 47 will be aligned so as to provide for tray sections 47 as illustrated in FIG. 1.

The same structure as defined above with respect to first rack member 11 also applies to second rack member 14 and third rack member 17. That is, second rack member 14 includes surfaces 14*a* and 14*b* which respectively cooperate with sections 21*a* and 21*b* of second opening 21, so as to respectively form downwardly inclined portion 27*a* and upwardly inclined portion 27*b* of second processing path 27, when second rack member 14 is inserted within second opening 21. Additionally, a first common wall member 100 is defined between first opening 19 and second opening 21. One side of first common wall member 100 comprises section 19*b* of first opening 19 as described above, and the opposite side of first common wall member 100 comprises section 21*a* of second opening 21 which includes openings 49*a* for nozzles 49 that extend along downwardly inclined portion 27*a*.

Like first rack member 11, second member rack member 14 also includes a handle portion 14*c*, a curved surface 14*d* which matches the curvature of turnaround roller 35*a*, and a curved section 14*e* which matches the curvature of roller 41.

Like first and second rack members 11 and 14, third rack member 17 includes surfaces 17*a* and 17*b* which respectively cooperate with sections 23*a* and 23*b* of third opening 23 to form downwardly inclined portion 29*a* and upwardly inclined portion 29*b* of third processing path 29. A second common wall member 200 divides second opening 21 and the third opening 23. One side of second common wall member 200 comprises section 21*b* of second opening 21 which includes parts of overflow tray sections 50, and the opposite side of second common wall member 200 comprises section 23*a* of third opening 23 that includes openings 53*a* for nozzles 53.

Like first and second rack members 11 and 14, third rack member 17 includes a handle portion 17*c*, a curved surface 17*d* which has a curvature that matches the curvature of turnaround roller 37*a*, and a curved section 17*e* which has a curvature that matches roller 43.

As shown in FIG. 2, each of openings 19, 21 and 23 extend along respective axes 19', 21', 23' which make an approximately 45° angle with a horizontal line, and each of rack members 11, 14 and 17 are insertable into their respective openings along these axes. Additionally, each of openings 19, 21 and 23 are positioned vertically one above the other. This provides for a unique and compact arrangement which forms a plurality of processing sections, as well a continuous light-tight processing path It is noted that the angle at which the longitudinal axes of openings 19, 21 and 23 are inclined with respect to the horizontal axis is not limited to, for example, the 45° angle shown in the FIGS. 1 and 2, and can be varied depending on design considerations and the desired size of the processing apparatus.

Further adding to the compactness of processing apparatus 7 is the configuration of handle portions 11*c*, 14*c* and 17*c*. For example, each of handle portions 11*c*, 14*c*, 17*c* respectively include curved sections 11*e*, 14*e* and 17*e* which respectively match the curvature of rollers 39, 41 and 43. Therefore, when rack members 11, 14, 17 are inserted into respective openings 19, 21, 23 as illustrated in FIG. 1, as an example, section 11*e* forms part of the path which guides photosensitive material from first processing path 25 to the second processing path 27. Additionally, each of handle portions 11*c*, 14*c* and 17*c* can be configured to have a flat section 11*f*, 14*f* and 17*f*, such that when rack members 11, 14, 17 are inserted in their respective openings 19, 21, 23, flat sections 11*f*, 14*f* and 17*f* form part of the side wall of base member 9 to provide for a compact unit.

Therefore, with the apparatus of the present invention, a user can easily slide rack members 11, 14 and 17 within their respective openings 19, 21 and 23 so as to form the processing path for each processing section. Of course, the number of processing sections and rack members is not limited to those described and shown in the drawings. For example, the base member 9 can includes further openings if, for example, additional developing or washing stations are needed. These further openings can be inclined so as to match openings 19, 21 and 23 and can have further removable rack members associated therewith. As an alternative, apparatus 7 can include less openings and rack members. Thus, the number of openings and rack members can be based on design considerations such as type of processing, processing speed etc.

Additionally, as described above, common wall member 100 includes parts of overflow tray sections 47 for first processing path 25 and nozzle openings 49*a* for second processing path 27, while common wall member 200 includes parts of overflow tray sections 50 for second processing path 27 and nozzle openings 53*a* for third processing path 29. This further adds to the compact arrangement of the apparatus.

Also, each of rack members 11, 14 and 17 can be slideable into and from their respective openings 19, 21 and 23 through, for example, a guide (not shown) that can be provided on the sides of base member 9 which match the edges of rack members 11, 14 and 17. This permits the easy insertion and removal of rack members 11, 14 and 17 into and from their respective openings 19, 21 and 23 and facilitates maintenance and repair of the apparatus.

Base member 9 can further include squeegee-like members 300 at the entrance of each opening 19, 21, 23. Squeegee-like members 300 are effective to wipe solution from the surface of rack members 11, 14, 17 as they are removed and/or inserted in their respective openings.

Figure 3:
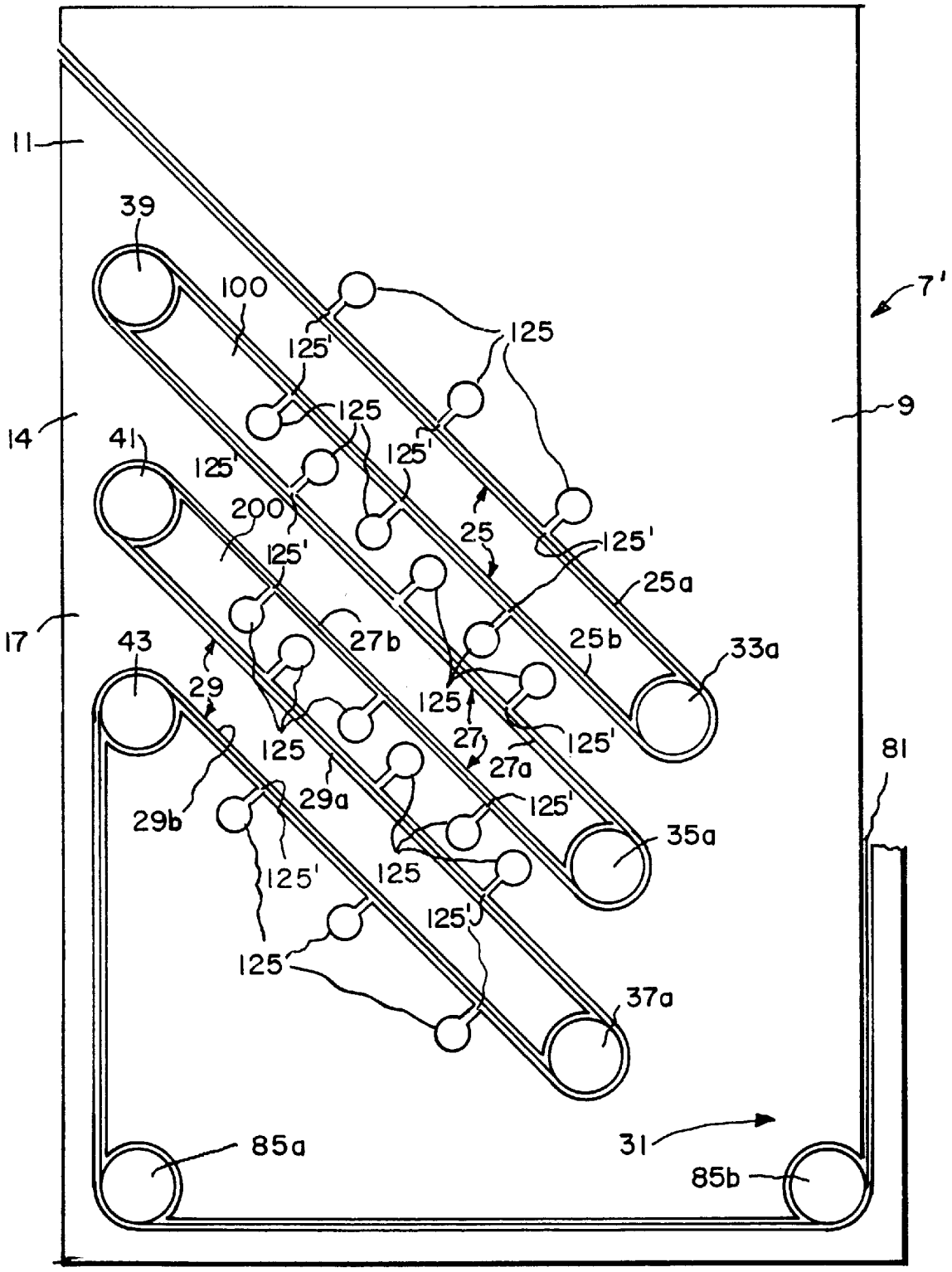
FIG. 3 is a schematic illustration of a further embodiment of the processing apparatus of FIG. 1.
Figure 4:
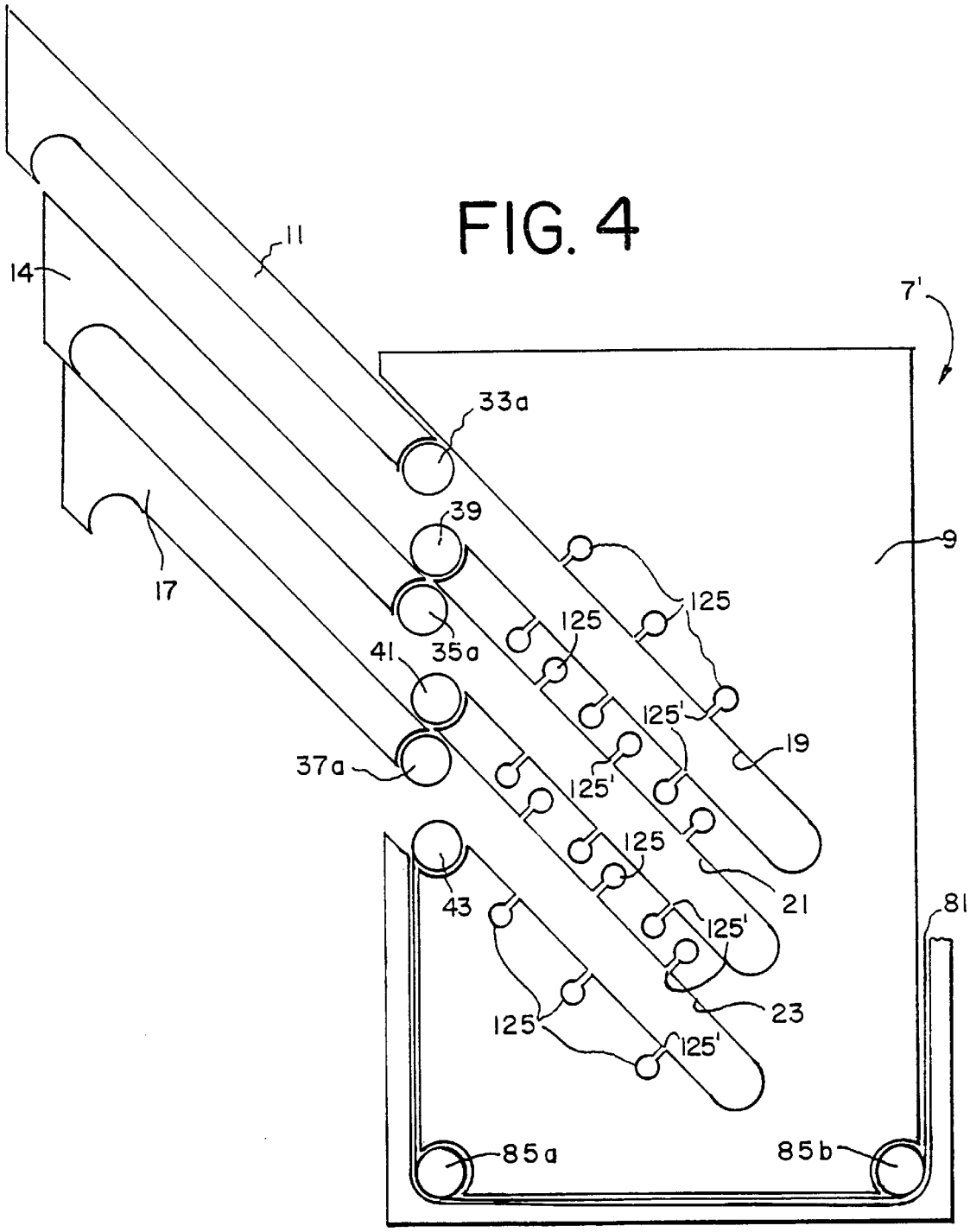
FIG. 4 illustrates the processing apparatus of FIG. 3 with the rack members being removed from the openings of base member.

Further, the mechanism for applying processing solution to the processing paths is not limited to that shown in FIG. 1. For example, instead of having the overflow tray sections along the upwardly inclined portions and nozzles along the downwardly inclined portions of the processing paths, nozzles can be provided along both the downwardly and upwardly inclined portions of each of the processing paths as shown in the embodiment of FIGS. 3 and 4. FIG. 3 illustrates a processing apparatus 7' which is similar to apparatus 7 illustrated in FIG. 1, but includes nozzles 125 along both the upwardly and downwardly inclined portions of each of processing paths 25, 27, 29. Therefore in the arrangement of FIG. 3, processing solution is applied via openings 125' of nozzles 125 along the upwardly and downwardly inclined portions of each processing paths 25, 27 and 29. The processing solution can be supplied to nozzles 125 by way of, for example, a pump arrangement as illustrated in FIG. 1. FIG. 4 illustrates processing apparatus 7' of FIG. 3 with rack members 11, 14, 17 removed from openings 19, 21, 23. The remaining features and manner of operation of processing assembly 7' as illustrated in FIGS. 3 and 4 is similar to processing apparatus 7 illustrated in FIGS. 1 and 2, with respect to the structure of the rack members and the base member. However, it is noted that with the use of nozzles 125 as illustrated in FIG. 4, the common wall members 100 and 200 between the openings 19, 21, 23 will be provided with nozzle openings 125' which open on opposite sides of common wall members 100, 200.

Figure 5A:
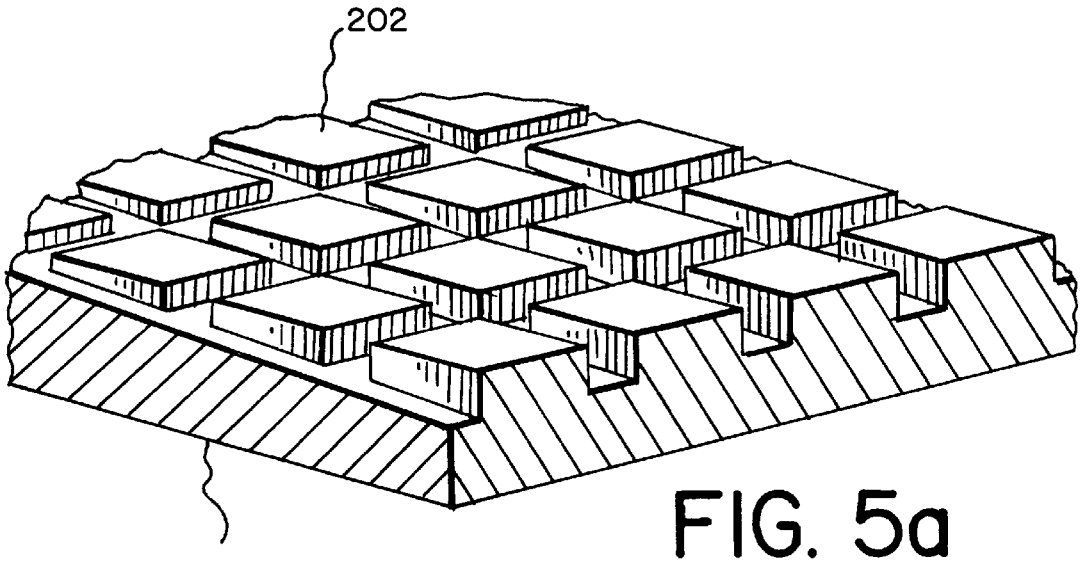
FIGS. 5*a* and 5*b* schematically illustrates textured surface which can be formed on the surfaces of the processing paths of the processing apparatus of the present invention.
Figure 5B:
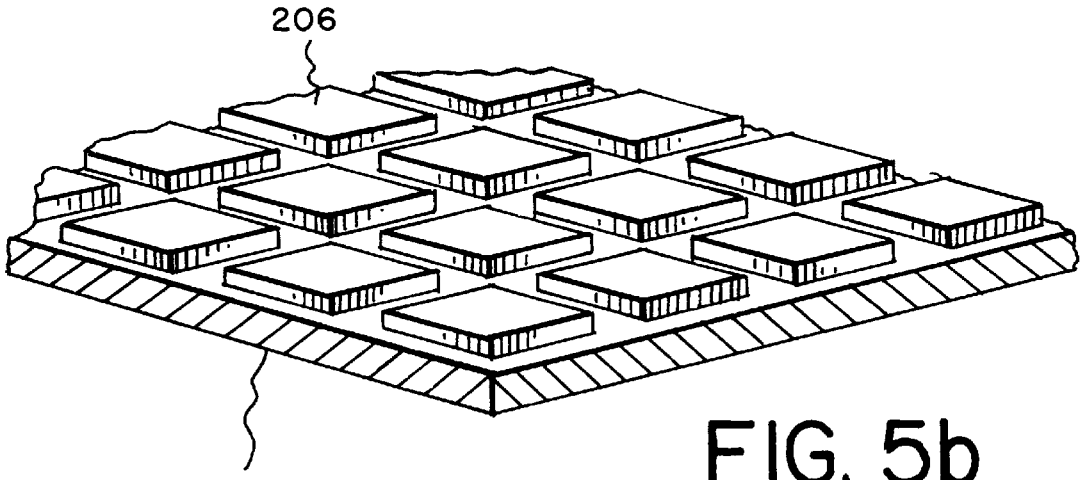

Referring now to FIGS. 5*a* and 5*b*, sections and/or surfaces 11*a*, 11*b*; 19*a*, 19*b*; 14*a*, 14*b*; 21*a*, 21*b*; 17*a*, 17*b*; 23*a*, 23*b*, of rack members 11, 14, 17 and openings 19, 21, 23, can be provided as desired with textured fluid/bearing surfaces which can be formed based on design considerations. The surfaces are textured to enhance fluid agitation and can be formed by any known process, e.g. knurling, molded, EDM electrical discharge machine, etc. Each of the surfaces can be structured so as to have knurls 202 or 206 as respectively illustrated in FIGS. 5*a* and 5*b*. In FIG. 5*a*, the knurls 202 are cantered so as to improve the flow of processing solution between the photosensitive material and the surfaces, and prevent the photosensitive material from sticking on the surfaces.

The invention has been described in detail with particular reference to certain preferred embodiments thereof, but it will be understood that variations and modifications can be effected within the spirit and scope of the invention.

What is claimed is:

1. A processing apparatus for photosensitive material, the apparatus comprising:

a base member having at least one opening, said at least one opening having a longitudinal axis which extends at a predetermined angle with respect to a horizontal axis; and at least one rack member which is removably insertable into said at least one opening, so as to define a processing path for photosensitive material therebetween when said at least one rack member is inserted in said at least one opening.

2. A processing apparatus according to claim 1, further comprising means for delivering processing solution to said processing path.

3. A processing apparatus according to claim 2, wherein said means for delivering processing solution is at least one of nozzle openings or overflow tray sections.

4. A processing apparatus according to claim 1, wherein:

a first section of an inner surface of said at least one opening extends along a downwardly inclined portion of said processing path with respect to a conveying direction of the photosensitive material in said downwardly inclined portion, said first section of said inner surface of said at least one opening comprising nozzle openings for delivering processing solution to said downwardly inclined portion; and a second section of the inner surface of said at least one opening extends along an upwardly inclined portion of said processing path with respect to a conveying direction of the photosensitive material in said upwardly inclined portion, said second section of said inner surface of said at least one opening comprising overflow tray sections which permit an overflow of processing solution for delivering processing solution to said upwardly inclined portion.

5. A processing apparatus according to claim 1, wherein said longitudinal axis of said at least one opening extends at an approximately 45 degree angle with respect to the horizontal axis.

6. A processing apparatus according to claim 4, further comprising a pump arrangement which delivers processing solution to at least one of said overflow tray sections so as to cause an overflow of said processing solution and a downwardly cascading flow of said processing solution along the upwardly inclined portion of the processing path.

7. A processing apparatus according to claim 6, further comprising a recirculation assembly which recirculates processing solution from said downwardly cascading solution flow to said nozzle openings which deliver said recirculated processing solution along said downwardly inclined portion of said processing path.

8. A processing apparatus according to claim 1, wherein said at least one rack member comprises a handle member which facilitates an insertion and removal of said at least one rack member into and from said at least one opening.

9. A processing apparatus according to claim 1, wherein a lower end of said at least one rack member comprises a turn-around roller, said lower end of said rack member having a curvature which matches a curvature of said turn-around roller.

10. A processing apparatus according to claim 1, wherein said processing solution is one of a developing solution, a bleaching solution, a fixing solution or a washing solution.

11. A processing apparatus for photosensitive material, the processing apparatus comprising:

a base member having a plurality of openings, each of said openings having a longitudinal axis which extends at a predetermined angle with respect to a horizontal axis, the longitudinal axes of each of said openings being approximately parallel to each other, and said openings being positioned one above the other;

a first rack member removably insertable in a first one of said plurality of openings, so as to define a first processing path for photosensitive material therebetween when said first rack member is inserted in said first one of said plurality of openings;

a second rack member removably insertable in a second one of said plurality of openings, so as to define a second processing path for photosensitive material therebetween which continues from said first processing path when said second rack member is inserted in said second one of said plurality of openings; and a third rack member removably insertable in a third one of said plurality of openings, so as to define a third processing path for photosensitive material therebetween which continues from said second processing path when said third rack member is inserted in said third one of said plurality of openings.

12. A processing apparatus according to claim 11, further comprising:

a first common wall member between said first one of said plurality of openings and said second one of said plurality of openings; and a second common wall member between said second one of said plurality of openings and said third one of said plurality of openings.

13. A processing apparatus according to claim 11, wherein:

said first processing path comprises a downwardly inclined portion with respect to a conveying direction of the photosensitive material in the downwardly inclined portion of the first processing path, and an upwardly inclined portion with respect to a conveying direction of the photosensitive material in the upwardly inclined portion of the first processing path;

a first section of an inner surface of said first one of said plurality of openings extends along the downwardly inclined portion of said first processing path and includes nozzle openings which extend therealong and deliver processing solution to the downwardly inclined portion of said first processing path; and a second section of said inner surface of said first one of said plurality of openings extends along the upwardly inclined portion of said first processing path and includes overflow tray sections extending therealong which deliver processing solution to the upwardly inclined portion of said first processing path, so as to provide for a downwardly cascading processing solution flow along the upwardly inclined portion of said first processing path caused by an overflow of processing solution in said overflow tray sections, said downwardly cascading processing solution flow leading to a turnaround portion of said first processing path.

14. A processing apparatus according to claim 13, wherein:

said second processing path comprises a downwardly inclined portion with respect to a conveying direction of the photosensitive material in the downwardly inclined portion of the second processing path, and an upwardly inclined portion with respect to a conveying direction of the photosensitive material in the upwardly inclined portion of the second processing path;

a first section of an inner surface of said second one of said plurality of openings extends along the downwardly inclined portion of said second processing path and includes nozzle openings which extend therealong and deliver processing solution to the downwardly inclined portion of said second processing path; and a second section of said inner surface of said second one of said plurality of openings extends along the upwardly inclined portion of said second processing path and includes overflow tray sections extending therealong which deliver processing solution to the upwardly inclined portion of said second processing path, so as to provide for a downwardly cascading processing solution flow along the upwardly inclined portion of said second processing path caused by an overflow of processing solution in the overflow tray sections, said downwardly cascading processing solution flow leading to a turnaround portion of said second processing path.

15. A processing apparatus according to claim 14, wherein:

said third processing path comprises a downwardly inclined portion with respect to a conveying direction of the photosensitive material in the downwardly inclined portion of said third processing path, and an upwardly inclined portion with respect to a conveying direction of the photosensitive material in the upwardly inclined portion of said third processing path;

a first section of an inner surface of said third one of said plurality of openings extends along the downwardly inclined portion of said third processing path and includes nozzle openings which extend therealong and deliver processing solution to the downwardly inclined portion; and a second section of said inner surface of said third one of said plurality of openings extends along the upwardly inclined portion of said third processing path and includes overflow tray sections extending therealong which deliver processing solution to the upwardly inclined portion of said third processing path, so as to provide for a downwardly cascading processing solution flow along the upwardly inclined portion of said third processing path caused by an overflow of processing solution in said overflow tray sections, said downwardly cascading processing solution flow leading to a turnaround portion of said third processing path.

16. A processing apparatus according to claim 15, further including a pump arrangement which comprises:

a first pump system which delivers a first processing solution to at least one of the overflow tray sections in said upwardly inclined portion of said first processing path;

a second pump system which delivers a second processing solution to at least one of the overflow tray sections in said upwardly inclined portion of said second processing path; and a third pump system which delivers a third processing solution to at least one of the overflow tray sections in said upwardly inclined portion of said third processing path.

17. A processing apparatus according to claim 15, further including a recirculation system which comprises:

a first recirculation pump assembly which recirculates processing solution from the downwardly cascading processing solution flow in the upwardly inclined portion of said first processing path to at least one of the nozzle openings along the downwardly inclined portion of the first processing path;

a second recirculation pump assembly which recirculates processing solution from the downwardly cascading processing solution flow in the upwardly inclined portion of the second processing path to at least one of the nozzle openings along the downwardly inclined portion of the second processing path; and a third recirculation pump assembly which recirculates processing solution from the downwardly cascading processing solution flow in the upwardly inclined portion of the third processing path to at least one of the nozzle openings along the downwardly inclined portion of the third processing path.

18. A processing apparatus according to claim 11, further comprising means for delivering processing solution to said first processing path, said second processing path and said third processing path.

19. A processing apparatus according to claim 18, wherein said means for delivering processing solution is at least one of a nozzle or an overflow tray section.

20. A processing apparatus according to claim 12, wherein:

said first common wall member comprises first means for delivering processing solution to the first processing path and second means for delivering processing solution to said second processing path; and said second common wall member comprises third means for delivering processing solution to said second processing path and fourth means for delivering processing solution to said third processing path.

21. A processing apparatus according to claim 20, wherein said first means for delivering processing solution is one of a nozzle or an overflow tray section and said second means for delivering processing solution is the other of said nozzle or said overflow tray section.

22. A processing apparatus according to claim 20, wherein said third means for delivering processing solution is one of a nozzle or an overflow tray section and said fourth means for delivering processing solution is the other of said nozzle or said overflow tray section.

23. A method of processing photosensitive material, the method comprising the step of:

forming at least one processing path for a passage of photosensitive material therethrough between an inner surface of at least one opening of a base member and an outer surface of at least one rack member removably insertable in said at least one opening, when said at least one rack member is inserted in said at least one opening, said at least one opening having a longitudinal axis which extends at a predetermined angle with respect to a horizontal axis.

24. A method according to claim 23, wherein said at least one processing path comprises a downwardly inclined portion with respect to a conveying direction of the photosensitive material in the downwardly inclined portion, and an upwardly inclined portion with respect to a conveying direction of the photosensitive material in the upwardly inclined portion.

25. A method according to claim 24, comprising the further steps of:

supplying processing solution to the upwardly inclined portion of the at least one processing path in a manner which causes a downwardly cascading flow of said processing solution in a direction which is opposite to the conveying direction of the photosensitive material in the upwardly inclined portion; and recirculating processing solution from the downwardly cascading processing solution flow to the downwardly inclined portion of the at least one processing path.

26. A method according to claim 23, wherein said longitudinal axis of said at least one opening extends at an approximately 45 degree angle with respect to said horizontal axis.

27. A method according to claim 24, wherein said processing solution is one of a developing solution, a bleaching solution, a fixing solution or a washing solution.

* * * * *